US011259659B2

(12) United States Patent
Zonnenberg et al.

(10) Patent No.: US 11,259,659 B2
(45) Date of Patent: Mar. 1, 2022

(54) DRINKING CUP PROVIDING ANY ANGLE DRINKING

(71) Applicant: KONINKLIJKE PHILIPS N.V., Eindhoven (NL)

(72) Inventors: Maaike Zonnenberg, Eindhoven (NL); Godalin Harshagen, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 100 days.

(21) Appl. No.: 16/342,378

(22) PCT Filed: Oct. 26, 2017

(86) PCT No.: PCT/EP2017/077496

§ 371 (c)(1),
(2) Date: Apr. 16, 2019

(87) PCT Pub. No.: WO2018/078037

PCT Pub. Date: May 3, 2018

(65) Prior Publication Data

US 2019/0254451 A1 Aug. 22, 2019

(30) Foreign Application Priority Data

Oct. 28, 2016 (EP) ..... 16196206

(51) Int. Cl.

| | |
|---|---|
| ***A47G 19/22*** | (2006.01) |
| ***A47G 19/30*** | (2006.01) |
| ***A47G 21/18*** | (2006.01) |

(52) U.S. Cl.

CPC ..... *A47G 19/2266* (2013.01); *A47G 21/18* (2013.01); *A47G 21/184* (2013.01); *A47G 21/185* (2013.01)

(58) Field of Classification Search

CPC ..... A47G 19/2266; A47G 19/2222; A47G 19/2272; A47G 21/18; A47G 21/185; A47G 21/184; A47G 21/183; A47G 21/189

(Continued)

(56) References Cited

U.S. PATENT DOCUMENTS

| | | | |
|---|---|---|---|
| 4,940,152 | A | 7/1990 | Lin |
| 5,160,058 | A | 11/1992 | Ahn |

(Continued)

FOREIGN PATENT DOCUMENTS

| | | |
|---|---|---|
| CN | 202198335 | 4/2012 |
| CN | 203341462 | 12/2013 |

(Continued)

OTHER PUBLICATIONS

International Search Report/Written Opinion dated Jan. 24, 2018.

*Primary Examiner* — Stephen J Castellano

(57) ABSTRACT

The present invention relates to a straw (1), a straw assembly (2) and a cup assembly (3). The straw (1) comprises first holes (13) in an upper half and second holes (14) in a lower half both arranged at the lateral surface of the straw (1). A sleeve element (20) can be arranged coaxially to and around the straw (1) to form a straw assembly (2). The sleeve element (20) is configured to close the first holes (13) in a first position and the second holes (14) in a second position. The straw assembly (2) can be arranged in a cup assembly (3). As the sleeve element (20) is also configured to float in a liquid the sleeve element (20) is moved through the force of buoyancy either to the first or the second position depending on the inclination of the cup assembly (3) with respect to the force of gravity. This provides a solution for any angle drinking.

19 Claims, 8 Drawing Sheets

(58) Field of Classification Search
USPC ..... 220/709; 239/33
See application file for complete search history.

(56) References Cited

U.S. PATENT DOCUMENTS

| | | | | |
|---|---|---|---|---|
| 5,848,721 | A | 12/1998 | Cornell | |
| 5,873,474 | A | 2/1999 | Gray | |
| 5,934,519 | A | 8/1999 | Kim | |
| 6,375,092 | B1 | 4/2002 | Banach | |
| 7,823,802 | B1 | 11/2010 | Roche | |
| 2004/0195347 | A1* | 10/2004 | Kim | A47G 21/185 239/33 |
| 2005/0061822 | A1* | 3/2005 | Naesje | A47G 21/18 220/705 |
| 2005/0195347 | A1 | 9/2005 | Wen | |
| 2014/0069885 | A1 | 3/2014 | Paxson | |
| 2017/0251848 | A1* | 9/2017 | Coon | A47G 21/182 |
| 2017/0354279 | A1 | 12/2017 | Lohn et al. | |

FOREIGN PATENT DOCUMENTS

| | | | |
|---|---|---|---|
| GB | 2270684 | A | 3/1994 |
| JP | 6010583 | U | 1/1985 |
| JP | 02105776 | A | 4/1990 |

* cited by examiner

DRINKING CUP PROVIDING ANY ANGLE DRINKING

This application is the U.S. National Phase application under 35 U.S.C. § 371 of international Application No. PCT/EP2017/077496, filed on Oct. 26, 2017, which claims the benefit of International Application No. 16196206.3, filed Oct. 28, 2016. These applications are hereby incorporated by reference herein.

FIELD OF THE INVENTION

The present invention relates to straw assembly for a drinking cup providing a solution for any angle drinking. In particular, the present invention relates to a straw, a straw assembly and a cup assembly.

BACKGROUND OF THE INVENTION

Drinking cups particularly for infants are well-known in the prior art in many variations. The majority of pediatricians will now recommend a straw cup as it is better for oral motor development as well as keeping the cavities away. Nonetheless, most of the parents use it as a comfortable means of drinking devices for drinking on the road and during activities without spilling. Some of the drinking cups also allow angle drinking.

In general, angle drinking means drinking from a object, in particular a cup, a bottle or e.g., by tilting the object with an angle of inclination in a relative position with respect to an axis, in particular the axis defined by the force of gravity. Any angle drinking means the ability of an object to provide drinking from any angle of inclination, even upside down.

Up until now, most of the straw cups focus on any angle drinking by means of a weighted straw. This does not work properly as the straw often bends and collapses. This makes it impossible for the child to suck the liquid from the cup. Secondly, the weighted straw cups all have a technical appearance and do not add a visual interesting feature to the child's drinking experience. Floating straws in general are designed either to stay afloat in total to be able to come out of a bottle opening or to prevent the straw to exit the cup or bottle for example when drinking soda.

GB 2 270 684 A discloses a training device for using straws, and especially for infants to learn to use straws. The training device includes a suction device comprising a engaging portion and a socket portion, a cap having a central hole, a straw and a bottle. The straw is inserted into the socket of the suction device. The suction device is inserted in an opening of the bottle such that the engaging portion is arranged outside the bottle, the socket portion is arranged inside the bottle and the straw is retained inside the bottle. The suction device is fixated on the opening of the bottle with the cap. Thus the straw is arranged inside the bottle and extends from the opening of the bottle almost to the bottom of the bottle.

CN 202198334 U discloses an anti-choking beverage drinking straw for children comprising a straight-through type straw. In particular, a small suction hole is arranged on the upper portion of the straight-through straw and four small water inlet holes are arranged at positions nearby the closed bottom of the straw. Thus, the straw reduces the suction force of the child to provide an anti-choking drinking.

SUMMARY OF THE INVENTION

It is an object of the present invention to provide an improved straw, straw assembly and cup assembly, which allow any angle drinking. Particularly, it is an object of the present invention to provide a straw and a straw assembly for a drinking cup that enables drinking without sucking air.

In a first aspect of the present invention a straw is presented that comprises:

a first open front end, a second closed front end, at least one first hole arranged on the lateral surface of the straw in a first portion of the straw extending from the center of the straw to the first open front end, and at least one second hole arranged on the lateral surface of the straw in a second portion of the straw extending from the center of the straw to the second closed front end.

In a further aspect of the present invention a straw assembly is presented comprising:

a straw as disclosed herein, and a sleeve element, wherein the length of the sleeve element is smaller than the length of the straw, wherein the sleeve element is arranged coaxially with and around the straw, wherein the sleeve element is movable parallel to the lateral surface of the first straw, and wherein the sleeve element is configured to float in the liquid.

In a further aspect of the present invention a cup assembly is presented comprising:

a straw assembly as disclosed herein, a container for storing a liquid, a lid element comprising a hole, wherein the lid element is arranged to close the container, wherein the straw is inserted into the hole and is arranged partially in the container, wherein the at least one first hole, the at least one second hole and the sleeve element are arranged inside the container and wherein the first open front end is arranged outside the container.

Preferred embodiments of the invention are defined in the dependent claims. It shall be understood that the straw assembly and the cup assembly have similar and/or identical preferred embodiments as the straw, in particular as defined in the dependent claims and as disclosed herein.

The present invention is based on the idea to make use of a modified straw and to arrange a movable and floating sleeve element around the straw forming a straw assembly. In particular, the straw comprises first holes in an upper half of the straw and second holes in the lower half of the straw and the sleeve element is configured to close the first or the second holes. The cup assembly filled with liquid may be tilted at any angle of inclination with respect to the force of gravity. The sleeve element is moved by the force of buoyancy and can switch between two positions; a first position closing the first holes and opening the second holes and a second position closing the second holes and opening the first holes. This allows water to access the straw through the opened holes and prevents air streaming in. Hence, a solution is provided for any angle drinking and for preventing a person, in particular a child or an infant, from sucking air.

The at least one first hole and the at least one second hole are arranged at the lateral surface of the straw. Thus, the second closed end of the straw can be close to or in contact with the bottom or any other surface of the cup or the liquid container without closing the at least one second hole at least partially. Closing the second hole at least partially would reduce the volume flow rate of the liquid. That would make drinking difficult or even impossible.

For instance, the cup assembly can be used as a training cup for infants or children for learning how to drink. Thereby it is important that children and infants learn the correct movements for drinking, such as tilting the cup, and do not have bad experiences like choking or sucking air.

Further, the cup assembly can be used as an auxiliary mean for drinking for old people or injured people, in particular retirement homes or hospitals. Still further, the cup assembly can be used by people for drinking on the road or during activities, in particular sports, without spilling.

According to an embodiment, the distance between the at least one first hole and the first open front end is in the range of 5 to 40%, in particular 10 to 25%, of the total length of the straw. Usually, the uppermost portion of the straw is arranged outside a cup or a liquid container while a person, in particular a child or an infant, uses the straw for drinking by taking the uppermost portion of the straw into his/her mouth for sucking the liquid. The length of the uppermost part of the straw is usually about 10 to 30% of the total length of the straw. The distance between the at least one first hole and the first open front end has to be bigger than the length of the uppermost portion to be arranged inside the cup. The at least one first hole has also to be arranged close to the lid element of the cup.

According to a further embodiment, the distance between the at least one second hole and the second closed front end is in the range of 0 to 40%, in particular 1 to 10%, of the total length of the straw. In particular, the above-mentioned distance is between 2 to 5% of the total length of the straw. If the liquid level is low in the cup assembly it may be an advantage that the at least second hole is close to the bottom of the cup while drinking.

According to a further embodiment, the straw comprises two or more first holes and/or two or more second holes. As mentioned already before the size of the diameter of the holes adjusts the suction force. Especially the cross-sectional area of the hole is proportional to the volume flow rate. Choosing one big hole or two small holes with the same cross-sectional area as the big hole adjust the same volume flow rate. Big holes destabilize the straw. Therefore, it is reasonable to arrange more than one first or second hole comprising the desired cross-sectional area.

According to a further embodiment, the two or more first holes and/or the two or more second holes are arranged around the perimeter of the straw and/or are arranged at several distances to the center of the straw. This configuration of the holes improves the stability of the straw. A destabilized straw can be affected by bending.

According to a further embodiment, the straw further comprises:

a first end portion between the the at least one first hole and the first open front end, a central portion between the at least one first hole and the at least one second hole, and a second end portion between the at least one second hole and the second closed front end, wherein the diameter of the straw and the central portion is smaller than the diameter of the straw in the first end portion and in the second end portion. In particular, a sleeve can be arranged surrounding the straw in the central portion wherein the length of the sleeve is smaller than the length of the central portion. The sleeve could be movable between the first and the second hole but cannot leave the central portion of the straw.

According to a further embodiment, the straw comprises a first transition portion between the first end portion and the central portion and a second transition portion between the central portion and the second end portion. The first transition portion and the second transition portion are configured step-like, wherein the at least one first hole is arranged in the first transition portion and the at least one second hole is arranged in the second transition portion. In particular, a sleeve can be arranged surrounding the straw in the central portion wherein the length of the sleeve is smaller than the length of the central portion. The sleeve may be movable between the first and the second hole but cannot leave the central portion of the straw. This configuration of the at least one first and the at least one second holes provides an easier configuration of means, in particular a sleeve element, for closing the holes. In particular, a sleeve element has not to be in contact with the lateral surface of the straw except for closing the at least one first and at least one second hole.

According to a further embodiment, the straw comprises a ball valve that only opens when a suction force acts on the first open end of the straw. This valve assembly also prevents out-streaming liquid while tilting the cup upside down.

According to a further embodiment, the diameter of the at least one first hole is less, particularly much smaller than the diameter of the straw. Thus, the stability of the straw is only slightly impaired. If the diameter of the at least first hole and/or the at least second hole is bigger than the diameter of the straw the stability of the straw is much more impaired. Thus, bending of the straw would be possible.

According to a further embodiment, the straw comprises a solid and inflexible structure. In particular, the straw is formed by a solid and inflexible material chosen from a group of metal, iron, hard plastic or the like. The straw cannot bend or collapse. A collapsing straw would make drinking impossible. The solid and inflexible structure of the straw also results in an easy and cheap manufacturing of the straw.

According to a further embodiment, by choosing different sizes of the diameter of the at least one first hole and the at least one second hole arranged at the lateral surface of the straw the suction force can be adjusted. In particular, a small diameter of the holes especially if the diameter of the holes is much smaller than the diameter of the straw the volume flow rate is very small. This prevents infants or children from choking.

According to an embodiment, the sleeve element of the straw assembly is in contact with the straw and is movable along the lateral surface of the straw. Thereby the sleeve element can cover the at least one first hole or the at least one second hole without having any of noses, overhangs and juts.

According to a further embodiment, the length of the sleeve element of the straw assembly is smaller than the distance between the at least one first hole and the at least one second hole. Such a sleeve element cannot cover both the at least one first hole and the at least one second hole at the same time. Covering both holes to the same time prevents liquid streaming into the straw. If the sleeve element is arranged in a position like that drinking is impossible.

According to a further embodiment, the sleeve element of the straw assembly is arranged between the first transition and the second transition, wherein the inner diameter of the sleeve element is smaller than the diameter of the first end portion and the second end portion of the straw and is larger than the diameter of the central portion of the straw, wherein the sleeve is configured to close the at least one first hole in a first position when a first front end of the sleeve element is in contact with the first transition of the straw and to close the at least one second hole in a second position when a second front end of the sleeve element is in contact with the second transition of the straw. In particular, the movement of the sleeve element is limited between the first and the second transition portion. The sleeve element can move between the first and the second position. But the sleeve element cannot leave the straw.

According to an embodiment, the first front end of the sleeve element of the straw assembly comprises at least one first nose and the second front end comprises at least one second nose, wherein the at least one first nose is configured to plug in and to close the at least one first hole in the first position and the at least one second nose is configured to plug in and to close the second hole in the second position. By using the straw assembly for drinking the straw assembly may be affected by shaking. The plugged in noses are arranged in the holes sealed and vibration-proofed. Thus, shaking would not open the holes.

According to a further embodiment, the total density of the sleeve element of the straw assembly is less than 0.75 $g/cm^3$. With this density the sleeve element floats in most commercially available drinks.

According to a further embodiment, the sleeve element has also a solid and inflexible structure. In particular, the sleeve element is formed by a solid and inflexible material chosen from a group of metal, iron, hard plastic or the like. Thus, bending or collapsing of the straw is nearly impossible.

According to a further embodiment, the sleeve element provides a visual effect that makes the infant drinking cup interesting for infants or children. Therefore, the sleeve element may comprise a picture or a special color. Thus, the sleeve element provides a visually pleasing effect.

According to a further embodiment of the cup assembly, the distance between the second closed front end of the straw and the bottom of the container is less than 10%, particularly less than 5%, of the distance between the bottom of the container and lid element. It is an advantage to keep distance between the second closed front end of the straw and the bottom of the container as small as possible to enable drinking also with a low liquid level in the cup.

According to a further embodiment of the cup assembly, the distance between the first hole of the straw and the lid element is less than 10%, particularly less than 5%, of the distance between the bottom of the container and the lid element. It is also reasonable to keep the distance between the at least one first hole of the straw and the lid element as small as possible to enable drinking with a low liquid level in the cup, in particular while upside down drinking.

According to a further embodiment of the cup assembly, the lid element of the cup comprises a nipple or a spout to which the straw is positive-locking connected. While upside down drinking no liquid leaves the cup without active sucking on the nipple or the spout. This is a good feature for infant drinking cups because uncontrolled streaming liquid out of the cup leads to spilling the child.

According to a further embodiment of the cup assembly, the distance between the second closed front end of the straw and the bottom of the container is less than the length of the sleeve element. Thus, the sleeve element cannot leave the coaxially position on the straw by sliding to the bottom of the container.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
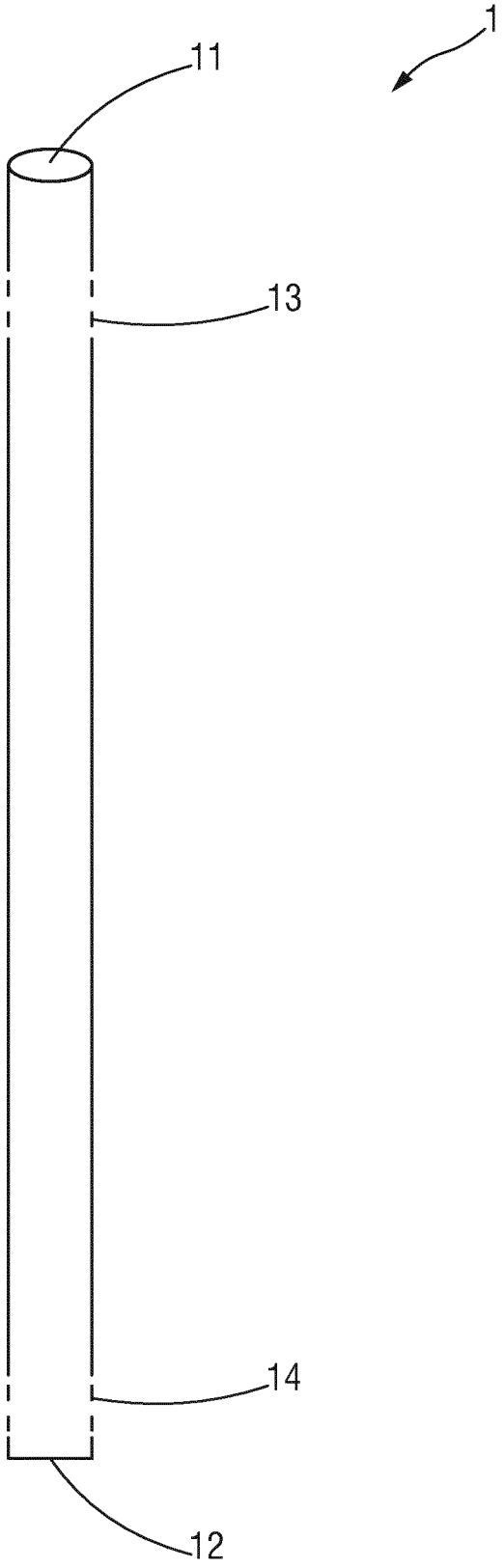
FIG. 1 shows a first embodiment of a straw according to the present invention.

FIG. 1 shows a first embodiment of a straw 1 according to the present invention. The straw 1 may be particularly used in a cup, in particular an infant drinking cup, for drinking liquid.

The straw 1 comprises a first open front end 11 and a second closed front end 12. First holes 13 are arranged on the lateral surface of the straw 1 in a first portion of the straw 1 extending from the center of the straw 1 to the first open front end 11. Second holes 14 are arranged on the lateral surface of the straw 1 in a second portion of the straw 1 extending from the center of the straw 1 to the second closed front end 12. The first holes 13 comprise several distances to the first open front end 11 and the second holes 14 comprise also several distances to the second closed front end 12. The first holes 13 and the second holes 14 are arranged around the perimeter of the straw 1.

Because the first holes 13 and the second holes 14 are distributed along and around the lateral surface of the straw 1, the stability of straw 1 at the positions of the first hole and of the second hole is only slightly impaired. The distance between the first open front end 11 and the first holes 13 is around 13% of the total length of the straw 1. The distance between the second holes 14 and the second closed front end 12 is around 3% of the total length of the straw 1. The configuration of the first and second holes 13, 14 on the straw 1 is reasonable for using the straw in combination with a closed cup for any angle drinking.

Figure 2:
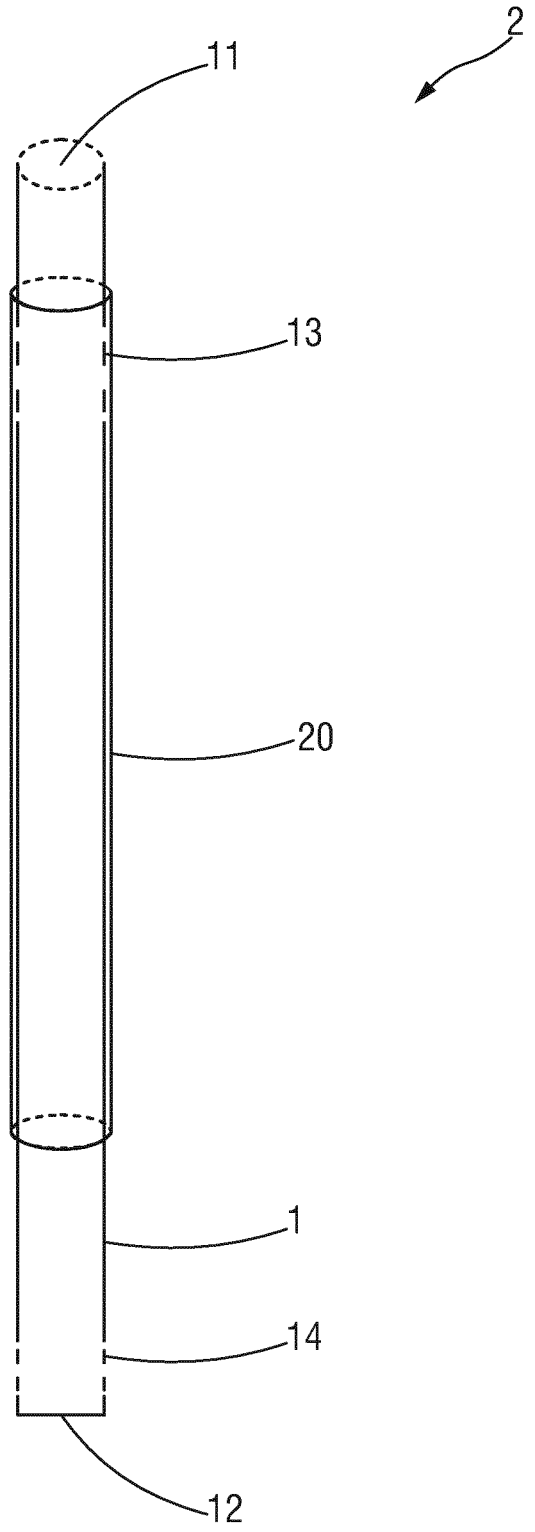
FIG. 2 shows a first embodiment of a straw assembly according to the present invention.

FIG. 2 shows a first embodiment of a straw assembly 2 according to the present invention. The straw assembly 2 comprises a straw 1 as described in FIG. 1 and a sleeve element 20. The sleeve element is arranged coaxially with and around the straw 1. The sleeve element is movable parallel to the lateral surface of the straw 1 and is configured to float in a liquid. The sleeve element 20 is smaller than the length of the straw 1, in particular the length of the sleeve element 20 is smaller than the distance between the first holes 13 and the second holes 14. The sleeve element 20 is in contact with the straw 1 and is movable along the lateral surface of the straw 1.

The sleeve element 20 is movable to a first position illustrated in FIG. 2 in which the first holes 13 are covered and closed by the sleeve element 20. The sleeve element 20 is also movable into a second position in which the second holes 14 are covered and closed. As the sleeve element 20 is configured to float in a liquid, the sleeve element can be moved into the first or the second position by the force of buoyancy.

Figure 3:
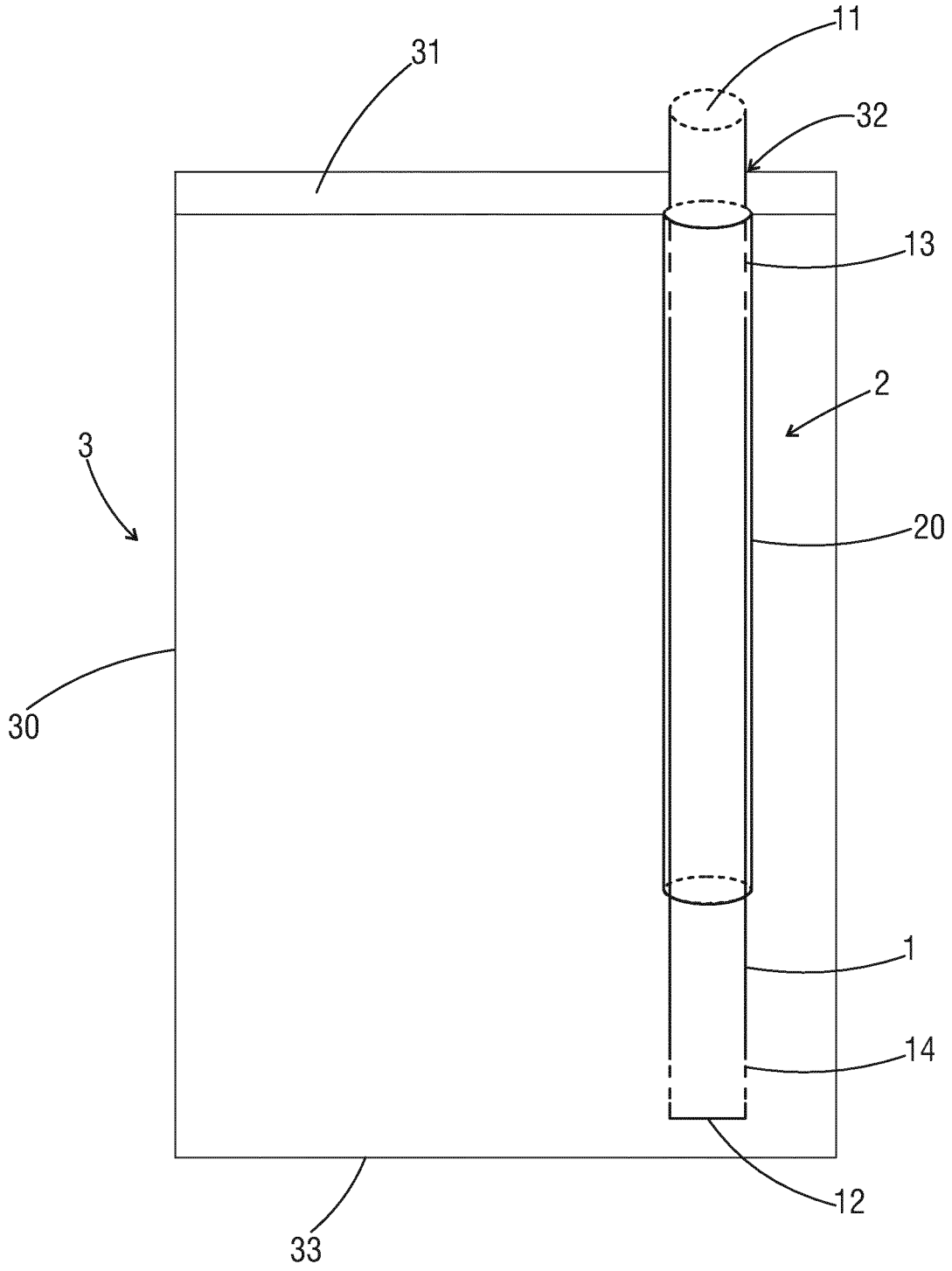
FIG. 3 shows a first embodiment of a cup assembly according to the present invention.

FIG. 3 shows an embodiment of a cup assembly 3 according to the present invention. The cup assembly 3 comprises a straw assembly 2 as described in FIG. 2, a container 30 for storing a liquid, and a lid element 31 comprising a hole 32. The lid element 31 is arranged to close the container 30. The straw assembly 2 is inserted into the hole 32 and is arranged partially in the container 30, such that the first holes 13, the second holes 14 and the sleeve element 20 are arranged inside the container 30 and the first open front end 11 of the straw 1 arranged outside the container 30. The straw assembly 2 is arranged positive-locking in the hole 32. The distance between the second closed front end 12 of the straw 1 is less than 5% of the distance between the bottom 33 of the container 30 and the lid element 31. The distance between the first holes 13 of the straw 1 and the lid element 31 is less than 5% of the distance between the bottom 33 of the container 30 and the lid element 31.

Figure 4:
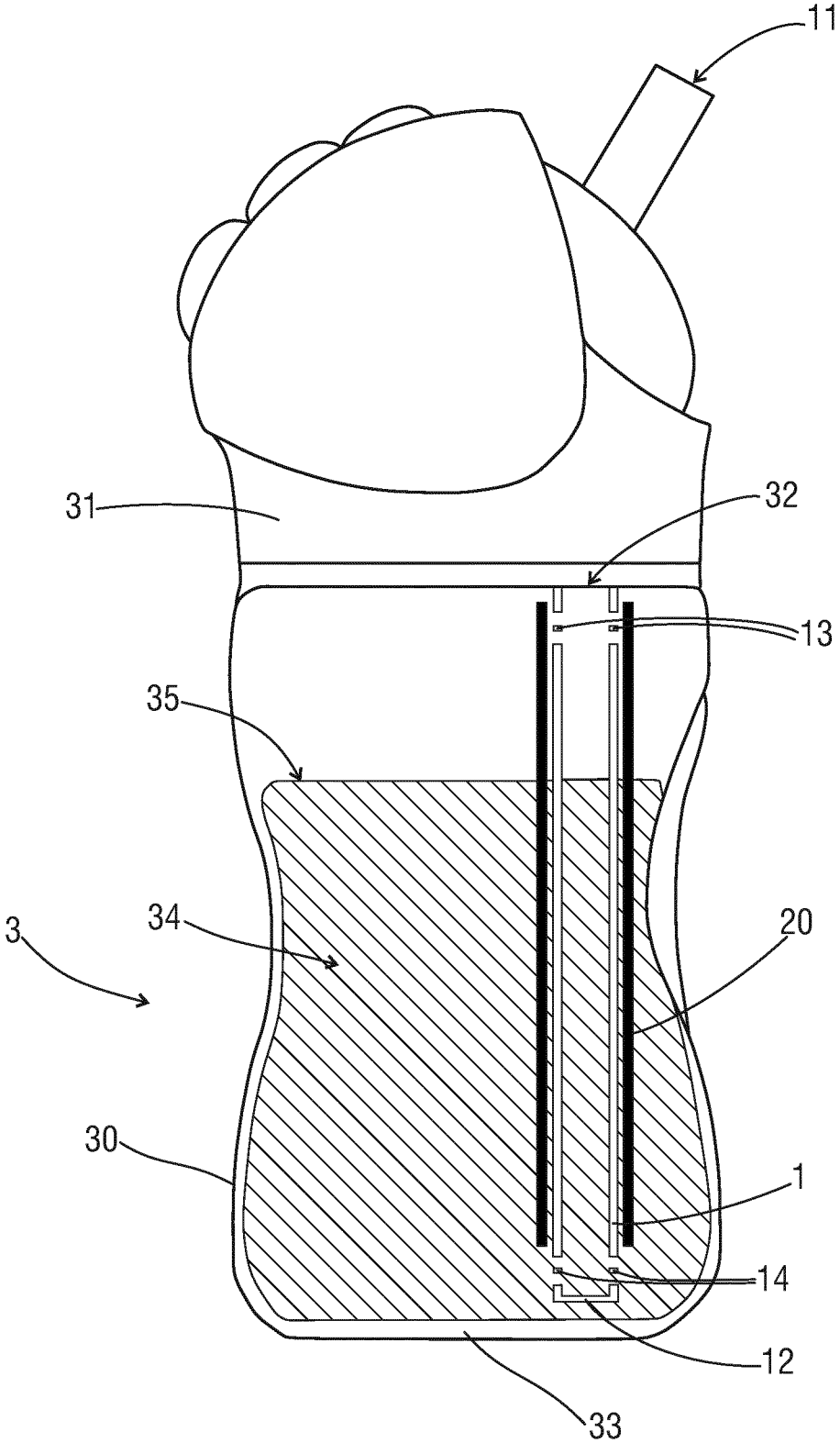
FIG. 4 shows a functional imaging of the first embodiment of the cup assembly showing the floating behavior of the sleeve element covering the at least one first hole and opening the at least one second hole of the straw.
Figure 5:
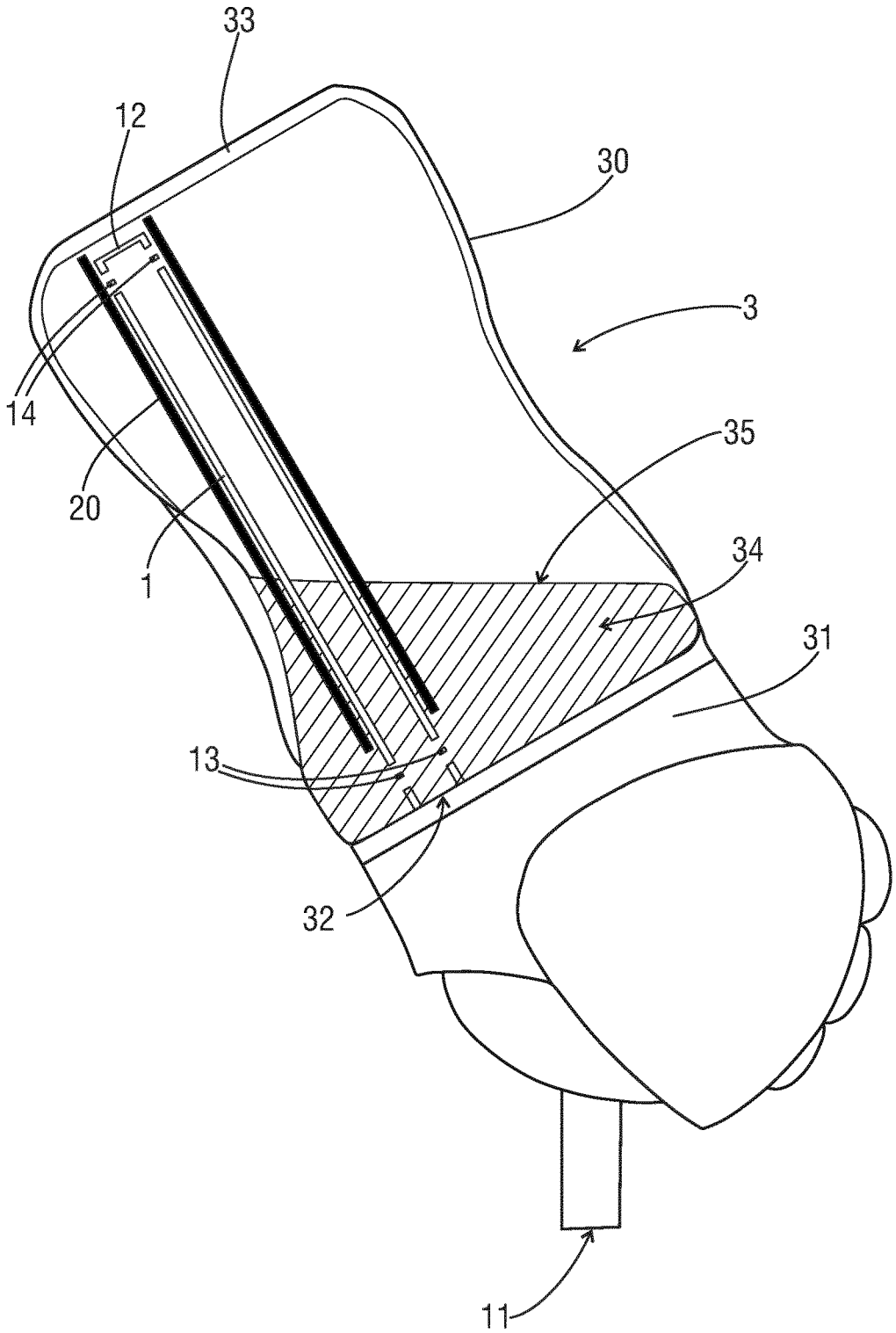
FIG. 5 shows a second functional imaging of the first embodiment of the cup assembly, wherein the cup assembly shown in FIG. 4 is tilted upside down and the sleeve element covers now the at least one second hole and opens the at least one first hole of the straw.

FIG. 4 and FIG. 5 show the functional manner of the cup assembly 3. FIG. 4 shows the cup assembly 3 in a first regular orientation with respect to the force of gravity. In respect to the force of gravity the bottom 33 of the container 30 is at a lower position and the lid element 31 closing the container 30 is at a upper position. The liquid 34 inside the container 30 is arranged in a liquid portion of the container 30 extending from the bottom 33 of the container to the liquid level 35. In an air portion between the liquid level 35 and the lid element 31 air is arranged. Through the force of buoyancy the sleeve element 20 is pushed upwards. The sleeve element 20 covers and closes the first holes 13. The second holes 14 are opened. While sucking at the first open front end 11 of the straw 1 liquid 34 streams through the second holes 14 into the straw 1. The first holes 13 are closed. No air can stream into the straw 1.

FIG. 5 shows the same cup assembly 3 as described in FIG. 4. The cup assembly 3 is now tilted upside down. With respect to the force of gravity the bottom 33 of the container 30 is at a upper position and the lid element 31 closing the container 30 is at a lower position. The liquid portion of the cup assembly 3 is now extending from the lid element 31 to the liquid level 35. The air portion is now extending from the liquid level 35 to the bottom 33 of the container 30. Through the force of buoyancy the sleeve element 20 is pushed upwards to the bottom 33 of the container 30. The sleeve element 20 covers the second holes 14 of the straw 1 located in the air portion. The first holes 13 of the straw 1 located in the liquid portion are opened. While sucking at the first open front end 11 of the straw 1 liquid 34 streams through the first holes 13 into the straw 1. As the second holes 14 are covered by the sleeve element 20, no air can stream into the straw 1.

Figure 6:
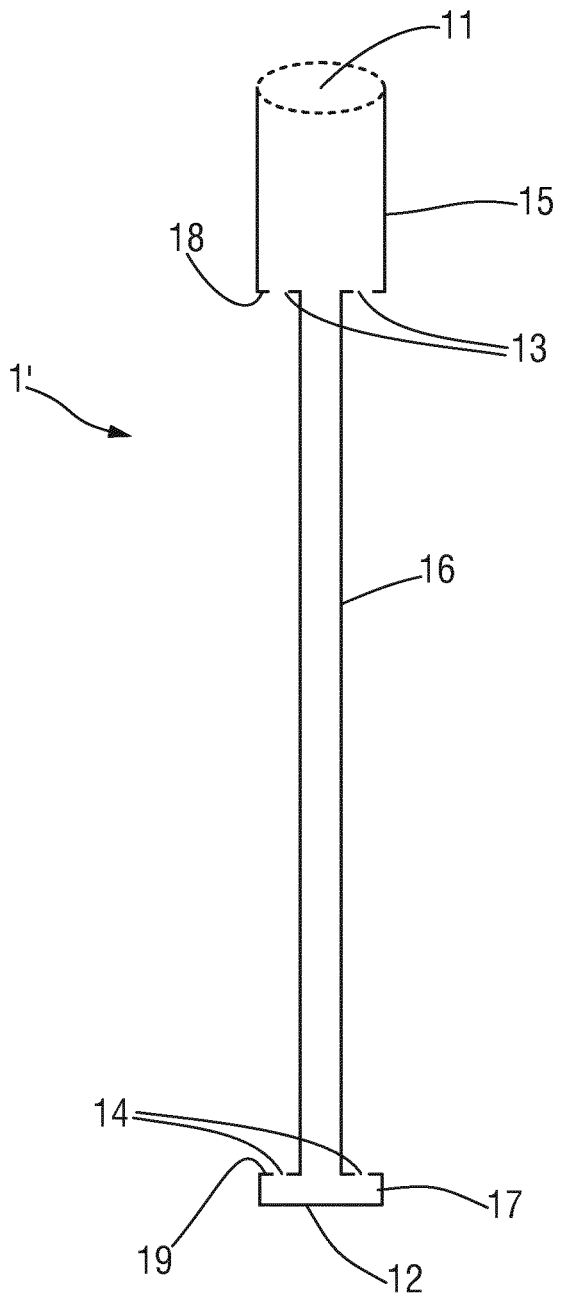
FIG. 6 shows a second embodiment of the straw according to the present invention.

FIG. 6 shows a second embodiment of the straw 1'. The straw 1' may comprise a first open front end 11 and a second closed front end 12. The straw 1 is portioned into three portions: a first end portion 15 adjacent to the first open front end 11, a second end portion 17 adjacent to the second closed front end 12 and a central portion 16 arranged between the first end portion 15 and the second end portion 17. A first transition portion 18 between the first end portion 15 and a central portion 16 is configured step-like. A second transition portion 19 between the central portion 16 and the second end portion 17 is also configured step-like. First holes 13 are arranged in the first transition portion 18. Second holes 14 are arranged in the second transition portion 19.

Figure 7:
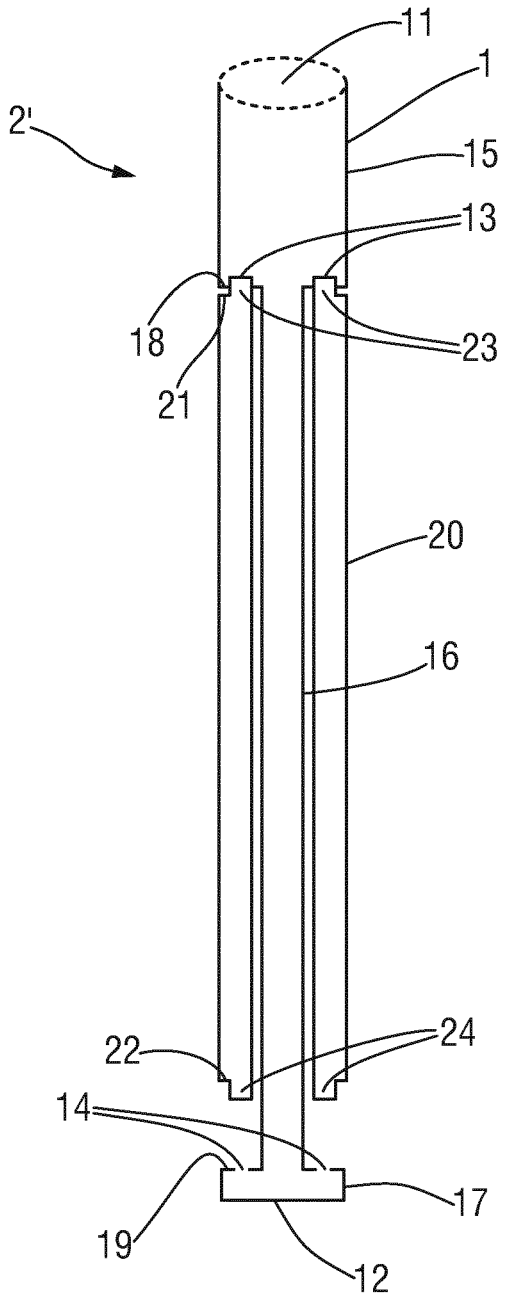
FIG. 7 shows a second embodiment according to the present invention, wherein the sleeve element is arranged between a first and a second step-like transition.

FIG. 7 shows a second embodiment of the straw assembly 2' according to the present invention. The straw assembly 2' comprises a straw 1' described in FIG. 6 and a sleeve element 20. The sleeve element 20 comprises a first front end 21 and a second front end 22. The first front end 21 comprises two first noses 23. The second front end 22 comprises two second noses 24. The inner diameter of the sleeve element 20 is smaller than the diameter of the first end portion 15 and the second end portion 17 of the straw 1 and is larger than the diameter of the central portion 16 of the straw 1. The length of the sleeve element 20 is smaller than the length of the central portion 16. The sleeve element 20 is arranged between the first end portion 15 and the second end portion 17.

The sleeve element 20 is movable into a first position in which the first front end 21 of the sleeve element 20 is in contact with the first transition portion 18 of the straw 1. The first noses 23 of the first front end 21 are configured to plug in and to close the first holes 13 of the straw 1 in the first position. The sleeve element 20 is also movable into a second position in which the second front end 22 of the sleeve element 20 is in contact with the second transition portion 19 of the straw 1. The second noses 24 of the second front end 22 are configured to plug in and to close the second holes 14 of the straw 1 in the second position.

Figure 8:
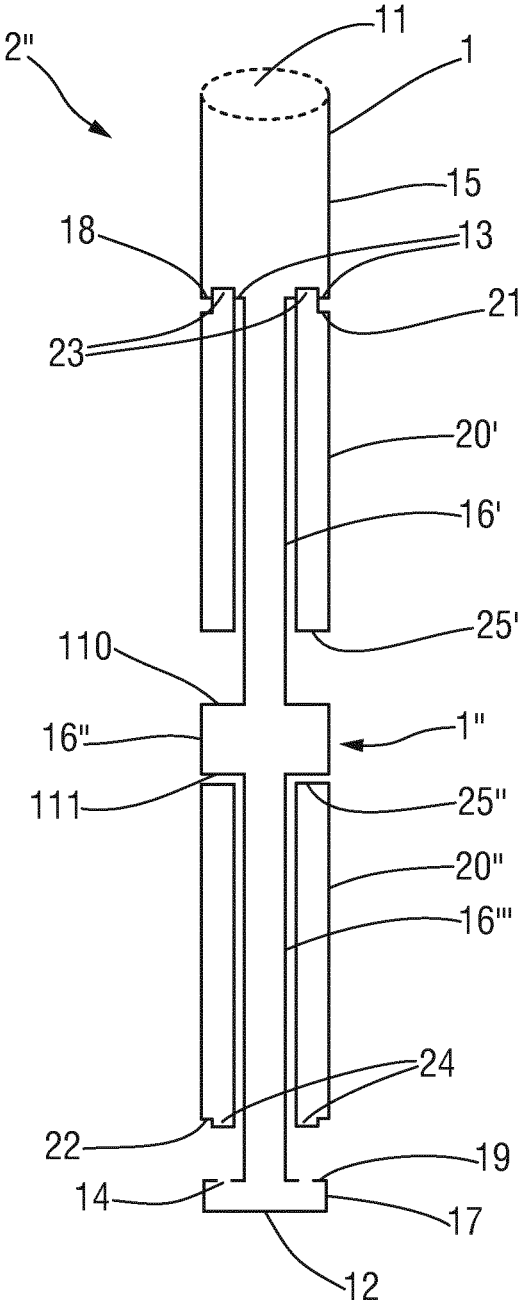
FIG. 8 shows a third embodiment of a straw assembly according to the present invention, wherein the straw assembly comprises two sleeve elements.

FIG. 8 shows a third embodiment of the straw assembly 2" according to the present invention. The straw assembly 2" may comprise a straw 1". The straw 1 comprises a first open front end 11 and a second closed front end 12. The straw 1 is portioned into five portions: a first end portion 15 adjacent to the first open front end 11, a second end portion 17 adjacent to the second closed front end 12, a first central portions 16', a second central portion 16" and a third central portion 16'", wherein the first, second and third central portions 16', 16", 16'" are arranged between the first end portion 15 and the second end portion 17. A first transition portion 18 between the first end portion 15 and the first central portion 16' is configured step-like. A second transition portion 19 between the third central portion 16'" and the second end portion 17 is also configured step-like. A third transition portion 110 between the first central portion 16' and the second central portion 16" is also configured step-like. A fourth transition portion 111 between the second central portion 16" and the third central portion 16'" is also configured step-like. First holes 13 are arranged in the first transition portion 18. Second holes 14 are arranged in the second transition portion 19.

The straw assembly 2' further comprises a first sleeve element 20' and a second sleeve element 20". The first sleeve elements 20' comprises a first front end 21 and a first flat front end 25'. The first front end 21 comprises two first noses 23. The second sleeve element 20" comprises a second flat front end 25" and a second front end 22. The second front end 22 comprises two second noses 24. The inner diameter of the first and the second sleeve elements 20', 20" is smaller than the diameter of the first end portion 15, the second end portion 17 and the second central portion 16" of the straw 1 and is larger than the diameter of the first and the third central portions 16', 16'" of the straw 1. The length of the first sleeve element 20' is smaller than the length of the first central portion 16'. The first sleeve element 20' is arranged between the first end portion 15 and the second central portion 16". The length of the second sleeve element 20" is smaller than the length of the third central portion 16'". The second sleeve element 20" is arranged between the third central portion 16'" and the second end portion 17. The first and the second sleeve elements 20', 20" are configured to float in water.

The first sleeve element 20' is movable to a first position illustrated in FIG. 8 in which the first holes 13 are covered and closed by the first sleeve element 20'. The first sleeve element 20' is movable to a second position in which the first flat front end 25' of the first sleeve element 20' is in contact with the third transition portion 110 of the straw 1". The first holes 13 are opened in the second position. The second sleeve element 20' is movable into a third position illustrated in FIG. 8 in which the second flat front end 25" of the second sleeve element 20" is in contact with the fourth transition portion 111 of the straw 1". The second holes 14 are opened in the third position. The second sleeve element 20" is movable into a fourth position in which the second holes 14 are covered and closed.

As the first and the second sleeve elements 20', 20" are configured to float in a liquid, the first and the second sleeve elements 20', 20" can be moved into a first configuration by the force of buoyancy in which the first sleeve element 20' is moved to the first position and the second sleeve element 20" is moved to the third position. Thus, the first holes 13 are closed and the second holes 14 are opened.

By tilting the straw assembly 2" upside down the first and the second sleeve elements 20', 20" can be moved into a second configuration by the force of buoyancy in which the first sleeve element 20' is moved to the second position and the second sleeve element 20" is moved to the fourth position. Thus, the second holes 14 are closed and the first holes 13 are opened.

The cup assembly 3 described in FIGS. 3 to 5 may also comprise a spout or a nozzle arranged at the lid element 31. The spout or the nozzle may be connected to the straw. In particular the first open front end 11 ends in the spout or nozzle.

Further, the straw 1 and the straw assembly 2 may comprise a curved form. In particular, the sleeve element 20 may comprise a curved form that fits to the curved form of the straw 1.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A straw for use with a container and a lid element arranged to close the container, the straw comprising:

a first open front end;

a second closed front end, wherein the first open front end and the second closed front end define a substantially hollow interior therebetween;

at least one first hole arranged on a lateral surface of the straw in a first portion of the straw extending from a center of the straw to the first open front end, wherein the at least one first hole is positioned between the lid component and a bottom of the container and is in fluid communication with the first open front end; and at least one second hole arranged on the lateral surface of the straw in a second portion of the straw extending from the center of the straw to the second closed front end, wherein the at least one second hole is in fluid communication with the first open front end;

wherein the at least one first hole is positioned proximal to the lid component relative to the at least one second hole and the at least one second hole is positioned proximal to the bottom of the container relative to the at least one first hole, wherein the straw has a first position and a second position, such that:

in the first position, the at least one first hole is obstructed and the at least one second hole is open for flow of a liquid, and in the second position, the at least one first hole is open and the at least one second hole is obstructed for flow of the liquid, wherein the at least one first hole and the at least one second hole are both configured for flow of the liquid therethrough when the at least one first hole and the at least one second hole are exposed to the liquid, such that the liquid can exit the straw through the first open front end.

2. The straw as claimed in claim 1, wherein a distance between the at least one first hole and the first open front end is in a range of 5 to 40% of a total length of the straw.

3. The straw as claimed in claim 1, wherein a distance between the at least one second hole and the second closed front end is in a range of 0 to 40% of a total length of the straw.

4. The straw as claimed in claim 1, wherein the at least one first hole comprises two or more first holes, which are arranged around a perimeter of the straw and/or are arranged at several distances to the center of the straw.

5. The straw as claimed in claim 4, wherein the at least one second hole comprises two or more second holes, which are arranged around a perimeter of the straw and/or are arranged at several distances to the center of the straw.

6. The straw as claimed in claim 1, wherein the straw further comprises:

a first end portion between the at least one first hole and the first open front end;

a central portion between the at least one first hole and the at least one second hole; and a second end portion between the at least one second hole and the second closed front end, wherein a diameter of the straw in the central portion is smaller than a diameter of the straw in the first end portion and in the second end portion.

7. The straw as claimed in claim 6, wherein a first transition portion between the first end portion and the central portion and a second transition portion between the central portion and the second end portion are configured step-like, wherein the at least one first hole is arranged in the first transition portion and the at least one second hole is arranged in the second transition portion.

8. A straw assembly comprising:

the straw of claim 1; and a sleeve element configured to float in the liquid, the sleeve element being arranged coaxially with and around the straw, and having a length that is less than a length of the straw and less than a distance between the at least one first hole and the at least one second hole, wherein the sleeve element is movable parallel to the lateral surface of the first straw.

9. The straw assembly as claimed in claim 8, wherein the sleeve element is in contact with the straw and is movable along the lateral surface of the straw.

10. The straw assembly as claimed in claim 8, wherein the sleeve element is arranged between a first transition portion and a second transition portion, wherein an inner diameter of the sleeve element is smaller than the diameter of a first end portion and a second end portion of the straw and is larger than the diameter of a central portion of the straw, wherein the sleeve element is configured to close the at least one first hole in the first position when a first front end of the sleeve element is in contact with the first transition portion of the straw and to close the at least one second hole in the second position when a second front end of the sleeve element is in contact with the second transition portion of the straw.

11. The straw assembly as claimed in claim 8, wherein the sleeve element comprises a first front end including at least one first nose and a second front end including at least one second nose, wherein the at least one first nose is configured to plug in and to close the at least one first hole in the first position and the at least one second nose is configured to plug in and to close the second hole in the second position.

12. A cup assembly comprising:

the straw assembly of claim 8;

the container for storing the liquid; and the lid element arranged to close the container and comprising a hole into which the straw assembly is inserted and is arranged partially in the container, the at least one first hole, the at least one second hole and the sleeve element being arranged inside the container, wherein the first open front end is arranged outside the container.

13. The cup assembly as claimed in claim 12, wherein the distance between the second closed front end of the straw and a bottom of the container is less than 10%, optionally less than 5%, of the distance between the bottom of the container and the lid element.

14. The cup assembly as claimed in claim 12, wherein the distance between the first hole of the straw and the lid element is less than 10%, optionally less than 5%, of the distance between the bottom of the container and the lid element.

15. The straw assembly as claimed in claim 12, wherein the distance between the at least one first hole and the first open front end is in a range of 5 to 40% of a total length of the straw.

16. The straw assembly as claimed in claim 12, wherein the distance between the at least one second hole and the second closed front end is in a range of 0 to 40% of a total length of the straw.

17. The straw assembly as claimed in claim 12, wherein the at least one first hole comprises two or more first holes and/or the at least one second hole comprises two or more second holes.

18. The straw assembly as claimed in claim 17, wherein the two or more first holes and/or the two or more second holes are arranged around a perimeter of the straw and/or are arranged at several distances to a center of the straw.

19. The straw assembly as claimed in claim 8, wherein the length of the sleeve element is smaller than the distance between the at least two first holes and the at least two second holes.

* * * * *